United States Patent [19]

Kuhnert et al.

[11] 4,262,611

[45] Apr. 21, 1981

[54] METHOD OF AND APPARATUS FOR WASTE INCINERATION

[75] Inventors: Dieter Kuhnert, Sinsheim; Lothar Meiler, Rauenberg; Herbert Rebholz, Leimen; Günter Zapf, Mannheim, all of Fed. Rep. of Germany

[73] Assignee: Kraftanlagen Aktiengesellschaft, Heidelberg, Fed. Rep. of Germany

[21] Appl. No.: 77,378

[22] Filed: Sep. 20, 1979

[30] Foreign Application Priority Data

Oct. 12, 1978 [DE] Fed. Rep. of Germany ..... 2844447

[51] Int. Cl.[3] ..... F23G 7/00

[52] U.S. Cl. ..... 110/346; 110/227; 110/229; 110/248; 110/298

[58] Field of Search ..... 110/235, 248, 298, 204, 110/227, 256, 229, 346, 238

[56] References Cited

U.S. PATENT DOCUMENTS

| | | | |
|---|---|---|---|
| 3,411,465 | 11/1968 | Shirai | 110/227 |
| 3,861,332 | 1/1975 | Itasaka | 110/227 |
| 4,156,394 | 5/1979 | Maller et al. | 110/248 X |
| 4,194,455 | 3/1980 | Mallek et al. | 110/346 X |

*Primary Examiner*—Edward G. Favors

[57] ABSTRACT

A method of and installation for incineration of solid and, if desired, liquid waste. The installation comprises a pyrolysis chamber and connected directly therebelow a combustion chamber. Exhaust gas ducts which cover the outer walls of the pyrolysis chamber either partly or completely in such a way that the covered wall surfaces of the pyrolysis chamber serve as the inner walls of the exhaust gas ducts. One or more swivelling gate elements which when moved create passages of different cross-sections through which solid and gaseous products from the pyrolysis process are discharged from the pyrolysis chamber into the combustion chamber. Combustion air supply inlets are arranged in flow direction behind the gate elements. The exhaust gas ducts are vertically subdivided on the outside walls of the pyrolysis chamber so that each of the individual partial ducts is provided with gas outlets which penetrate the outside walls of the pyrolysis chamber where they are covered by the exhaust gas ducts, and enter into the pyrolysis chamber whereby every part of the exhaust gas ducts serves to supply exhaust gas heat directly to the waste fill in the pyrolysis chamber.

10 Claims, 3 Drawing Figures

METHOD OF AND APPARATUS FOR WASTE INCINERATION

BACKGROUND OF THE INVENTION

The invention relates to both, a method of incineration of solid and, if desired, liquid waste, and to an apparatus for carrying out the method. Such apparatus is disclosed in German Pat. No. 2654041. It comprises two vertically arranged superjacent chambers, i.e. a pyrolysis chamber and connected directly to its bottom outlet, a combustion chamber; exhaust gas ducts which cover the outer walls of the pyrolysis chamber either partly or completely in such a way that the covered wall surfaces of the pyrolysis chamber serve as the inner walls of the exhaust gas ducts; one or more swivelling gate elements between the pyrolysis and combustion chambers, the upper side of which elements is closed (i.e. is uninterrupted or unpierced; has no openings going through) while the swivelling gate elements are supported on a shaft or axle in such a way that, when moving them, passages of different cross-sections are obtained through which solid and gaseous products from the pyrolysis process are discharged from the pyrolysis chamber into the combustion chamber; and combustion air supply inlets which are arranged in flow direction behind the gate elements.

With the installation disclosed in German Pat. No. 2654041 wastes of different types can be incinerated without its presorting being necessary since, in dependence upon the combustion characteristics of the waste, the swivelling gate elements can discontinuously or continuously be operated, primary and secondary air can adequately be supplied, the waste and gas flows can efficiently be directed through the installation, and the necessary glow bed can properly develop in the pyrolysis chamber.

The gate elements serve to maintain the glow bed at the required depth and to permanently turn over its constituents. In dependence upon the cross-section of the passage between the gate elements, only particles of the desired small size are discharged into the lower combustion chamber. Besides regulating the waste and gas circulation within the installation by properly operating the swivelling gate elements, the recirculation of exhaust gas heat is of considerable importance for an economic pyrolysis and incineration process. Where the walls of the pyrolysis chamber are covered by the exhaust gas ducts, the waste heat of the exhaust gases is transferred through the walls to the waste flow and the center of the waste fill by heat conduction. Heat transfer is additionally favored by the slender design of the installation. With unchanging operation parameters, e.g. wall surface, exhaust gas temperature, the heat transfer through the walls of the pyrolysis chamber is unchanging too, and mainly depends on the geometrical shape of the pyrolysis chamber which means that independent regulation of either the drying, degassing or gasification processes in the individual sections of the pyrolysis chamber is aggravated.

It is an object of the present invention to affect the individual processes which take place in the prolysis chamber, independently from each other and to avoid their direct dependence upon the geometrical shape of the pyrolysis chamber.

Consequently, as a further development of the invention disclosed in German Pat. No. 2654041 the incineration installation of the present invention is characterized by the exhaust gas ducts on the outside walls of the pyrolysis chamber being vertically subdivided into individual partial ducts; these partial ducts being provided with gas outlets which penetrate the outside walls of the pyrolysis chamber where they are covered by the exhaust gas ducts, and enter into the pyrolysis chamber; whereby each individual part of the exhaust gas ducts serves to supply exhaust gas directly to the waste flow and to the center of the waste fill, in sections.

Via the gas outlets of the partial ducts leading into the pyrolysis chamber, partial flows of the exhaust gases are led directly into the pyrolysis chamber.

These partial flows are led separately from each other into the vertically arranged sections of the pyrolysis chamber in which the partial processes, i.e. drying, degassing, and gasification as well as partial combustion takes place. Thus, the heat and oxygen supply to these sections can be adjusted to actual requirements by simple regulating devices, and an interference or overlap of the partial processes is countered. According to the heat content of the exhaust gases, the temperatures of the exahust gas partial flows to the various partial ducts can individually be lowered by intermediate cooling and thus individually adjusted to the requirements of the partial processes within the pyrolysis chamber. It is also possible to adjust the oxygen content of each of the exhaust gas partial flows to the requirements of the partial processes within the pyrolysis chamber by air admixture. Heat supply is effected directly and thus quickly and efficiently right to the center of the waste fill since with the present invention heat transfer is carried out mainly by convection. In comparison with heat transfer by heat conduction, direct heat transfer offers the advantage of a more uniform temperature distribution over the chamber cross-section, due to a lower time constant. In addition, dependence of the temperature distribution upon the turnover of the waste fill is reduced. The heat and oxygen supply to each of the sections of the pyrolysis chamber is individually controllable by simple regulating devices arranged in the external piping system. The extent of these sections can be affected in the desired way, too.

In advantageous development of the main idea of the invention the combustion chamber which is connected at the outlet of the pyrolysis chamber, is subdivided into an incineration chamber for solid pyrolysis products and one for gaseous pyrolysis products. The latter one is paraxially connected to the solids incineration chamber. Both chambers are provided with secondary air supply openings in order to allow separate and independent regulation of the burn-out process of solid pyrolysis products and complete incineration of the gaseous ones. Only such an amount of combustion air is supplied to the solids incineration chamber as to just ensure the complete burn-out of the solid pyrolysis products passing through the opening which results from the movement of the swivelling gate elements, and the amount of combustion air supplied to the gas incineration chamber is regulated as to ensure complete incineration of the gaseous pyrolysis products. Thus, a low gas velocity is obtained in the solids incineration chamber and the deleterious effect of ash being carried along with the exhaust gases, is avoided. High gas velocities because of a larger amount of combustion air—the main part of secondary combustion air—supplied to the gaseous pyrolysis products as well as the expansion of exhaust gases when being burnt are encountered only in the gas incineration chamber.

Where movable and thus, delicate components of the installation are installed (especially in the transitional cross-section between pyrolysis chamber and solids incineration chamber), temperatures are low, whereas high temperatures develop only in the gas incineration chamber where the gaseous pyrolysis products are completely burnt, and which is separated from the other chambers of the installation.

There are some advantages when the bottom of the solids incineration chamber which is connected to the outlet of the pyrolysis chamber is also formed by one or more swivelling gate elements with a closed upper side and gas outlet openings on the under side from the movement of which result passages of different widths. With the air supplied through the gas outlet openings of these additional gate elements, the ash in the ash discharge chamber is cooled before the air is recirculated as combustion air through the passage of the second elements to the solid pyrolysis products resting on and being turned over by these gate elements.

BRIEF DESCRIPTION OF THE DRAWING

The characteristics of the present invention are illustrated in the accompanying drawing of an embodiment of an incineration installation with rectangular chamber cross-section, in which.

DETAILED DESCRIPTION OF A PREFERRED EMBODIMENT

Figure 1:
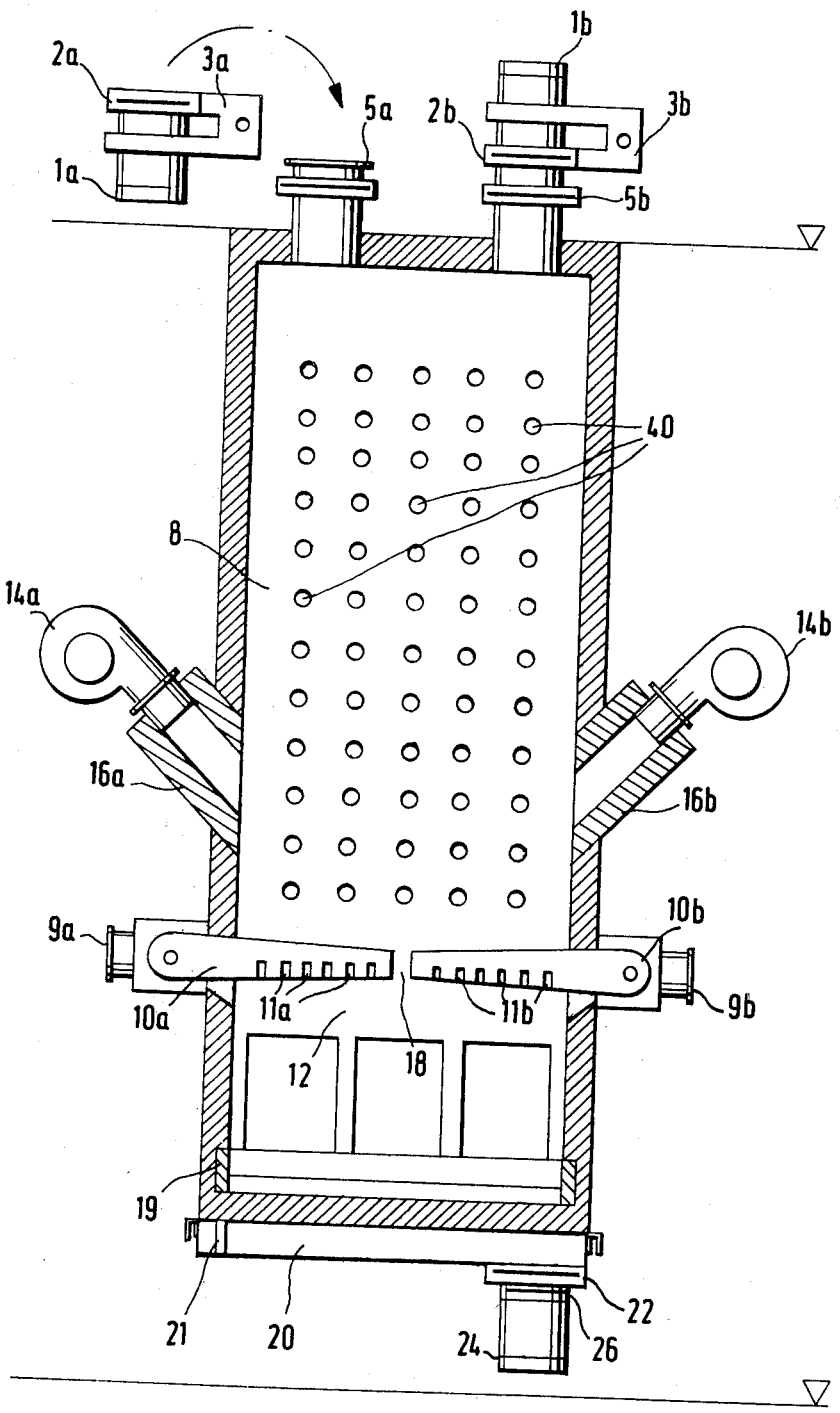
FIG. 1 is a section at the center line of the incineration installation, in parallel to the chamber wall of larger width.
Figure 2:
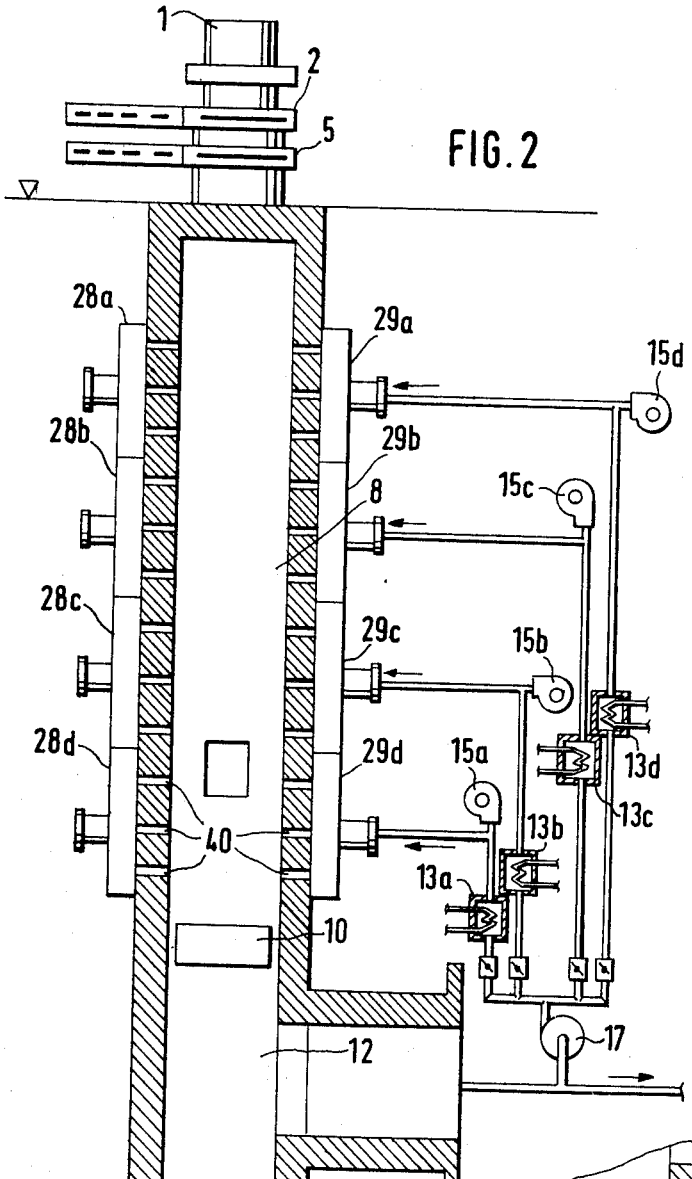
FIG. 2 is a section at the center line of the incineration installation, in parallel to the chamber wall of smaller width.

As shown in FIGS. 1 and 2, drums 1*a*, 1*b* in which the waste is delivered, are alternately placed on feed hoppers 5*a*, 5*b* by tilting them by 180°; the cover locks 2*a*, 2*b* of the drums are then connected to those of the feed hoppers of the incineration installation. The waste is discharged into the upper pyrolysis chamber 8 and piles up on the swivelling gate elements 10*a*, 10*b*. On the opposing side walls of the upper pyrolysis chamber 8 there are burners 14*a*, 14*b* arranged on burner sockets 16*a*, 16*b*, the flame cone axes of which intersect in one point on the installation's center line. After ignition of the burner, the heat supplied is concentrated to the center of the waste fill in order to start the endothermic drying, degassing and gasification processes. After the complete operation has been started, the burners can be switched off as soon as the recycled heat recovered from the exhaust gases of the combustion chamber establishes an equilibrium between the endothermic drying and degassing processes and the exothermic gasification process which takes place in the pyrolysis chamber.

For the heat recycling there are numerous openings 40 in the walls of the pyrolysis chamber, which openings are arranged horizontally one beside the other and vertically one above the other. Through these openings exhaust gases are led into the pyrolysis chamber. With these directly led-in exhaust gases which are tempered by intermediate cooling as to meet operation requirements, not only heat is supplied to the waste passing through the pyrolysis chamber, but also oxygen thus allowing to regulate the extent of the drying, degassing and gasification sections are desired. By moving the gate elements downwards and back again into a horizontal position, either by means of handles provided on the installation's outside (which are, however, not shown in the FIGURES) or by an appropriate drive, the cross-section of the passage 18 between pyrolysis and solids incineration chamber can be widened or reduced in size. With the movement of the gate elements, the waste in the pyrolysis chamber is loosened, and a glow bed of the required depth or volume is formed and maintained. After appropriate volume reduction, only waste particles of the desired size are discharged into the solids incineration chamber where they are burnt under addition of a part of secondary combustion air. This part of the secondary combustion air is supplied to the gate elements through openings 9*a*, 9*b* provided near the swivelling axis of the elements, serves to cool these gate elements, and flows to the solids combustion chamber 12 through openings 11*a*, 11*b* provided on the elements underside.

On the bottom of the combustion chamber there is an ash discharge frame 19 which encloses the developing ash heap. By means of this frame, the burnt ash constituents are discharged—in FIG. 1 rearwards—into the ash chamber 20. A discharge lock 22 is connected to the bottom of the ash chamber (in FIG. 1 the sluice is provided at the right side) through which the cooled ash is discharged by means of an ash conveyor 21 into an ash drum 24 having a cover lock 26.

FIG. 2 is a sectional view along the center line of the incineration installation of the present invention, in parallel to the chamber wall of smaller width. It shows the arrangement of the vertically subdivided gas ducts on the outer walls of the pyrolysis chamber. On both sides of the pyrolysis chamber gas outlet openings 40 are allocated to each of the partial ducts 28*a* to 28*d* and 29*a* to 29*d*. After cooling to the desired temperature by heat exchangers 13*a* to 13*d* and, if necessary, regulation of the oxygen content by air admixture with blowers 15*a* to 15*d* and pressurization by means of a blower 17, waste gases from the combustion chamber are fed to these partial ducts through the conduits schematically shown in FIG. 2. To insure that waste gases are more uniformly supplied to the individual part processes taking place in the pyrolysis chamber, a certain number of bores is allocated to each partial duct. The bores are arranged one beside the other and one above the other.

Figure 3:
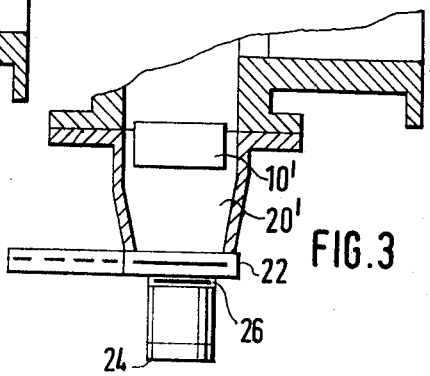
FIG. 3 is a section of the lower portion of a modified incineration installation, which when compared to FIG. 1 is complemented by gate elements provided in the transition area to the ash discharge chamber arranged vertically below.

FIG. 3 is a sectional view of the lower portion of a somewhat modified installation in which differently from the design of the ash disposal chamber of FIG. 1, the first gate elements between pyrolysis chamber and solids incineration chamber are followed by similar gate elements 10' arranged between solids incineration chamber and ash disposal chamber, thus forming the bottom of the solids incineration chamber. With the movement of these second gate elements 10' (from which result passages of different widths) solid residues from the pyrolysis process are discharged as ash into the ash disposal chamber 20'. Openings in the bottom side of the second gate elements 10' are provided for the supply of air which, in the first place, cools the ash in the ash disposal chamber and, in the second place, is led as combustion air to the solid pyrolysis products which rest on the second gate elements, where they are completely burnt. With the movement of the second gate elements 10' always new passages of different widths are opened in the fill of solid pyrolysis products and thus, complete burning is facilitated. The cold ash is discharged via lock 22 at the bottom of the ash disposal chamber and the cover lock 26, into the ash drum 24.

We claim:

1. Installation for the incineration of at least partly solid waste, said installation comprising a pyrolysis chamber and vertically therebelow a combustion chamber; exhaust gas ducts covering outer walls of the pyrolysis chamber at least partly in such a way that the covered wall surfaces of the pyrolysis chamber serve as the inner walls of the exhaust gas ducts; at least one swivelling gate element between said pyrolysis and combustion chambers, said at least one element having a closed, unperforated upper side and being pivotally supported in such a way that, when pivoted, passages of different cross-sections are obtained through which solid and gaseous products are discharged from the pyrolysis chamber into the combustion chamber; combustion air supply inlets arranged in flow direction behind said at least one gate element, said exhaust gas ducts being vertically subdivided into partial ducts on the outer walls of the pyrolysis chamber; each of said partial ducts being provided with gas outlets which penetrate the outer walls of the pyrolysis chamber where they are covered by said exhaust gas ducts, and entering into the pyrolysis chamber; whereby every part of the exhaust gas ducts serves to supply exhaust gas heat directly to waste in the pyrolysis chamber.

2. The installation according to claim 1, wherein said combustion chamber forms two partial chambers, one being a solids incineration chamber and the other a gas incineration chamber, both partial chambers being provided with secondary air supply openings, whereby almost separate incineration of solid and gaseous pyrolysis products can take place in said installation.

3. The installation according to claim 2, comprising an ash disposal chamber, and at least one additional swivelling gate element forming the bottom of the solids incineration chamber and arranged behind said at least one first gate element in flow direction of waste; movement of said at least one additional gate element resulting in passages of different widths through which waste material is adapted to be discharged into said ash disposal chamber.

4. The installation according to claim 3, wherein said additional gate element has a closed upper side, and an internal air circulation system for cooling said gate elements through which air is adapted to enter into said ash disposal chamber.

5. A method of incinerating at least partly solid wastes, in an installation having a pyrolysis chamber and a combustion chamber, and swivelling gate elements between said chambers, comprising: drying, degassing and gasifying said waste in the pyrolysis chamber; subsequently burning both the gaseous and the solid pyrolysis products in the combustion chamber, recirculating waste heat of the exothermic incineration process to the combustion chamber through the walls of the pyrolysis chamber in such a way that endothermic drying and degassing and exothermic gasification processes are started, moving said swivelling gate elements to open passages of different widths through which pass the solid and gaseous pyrolysis products, developing a glow bed of sufficient depth and temperature and maintaining the same above the gate elements to ensure efficient gasification and to weaken the solidity of the solid pyrolysis residues in such a way that they can, upon movement of the gate elements, be reduced to a particle size allowing a complete incineration, supplying secondary combustion air behind the gate elements in the direction of the solids and gas flows, and establishing exhaust gas partial flows adapted to be set to different temperatures by cooling and leading the same through boreholes provided in the walls of the pyrolysis chamber, to the center of the waste for direct heat exchange therewith.

6. The method according to claim 5, wherein in addition a different oxygen content is set in said last-mentioned step by admixing air.

7. The incineration method according to claim 5, wherein solid and gaseous pyrolysis products are incinerated in separate part chambers of solids and a gas incineration chamber, said part chambers being connected in series; the incineration of solid and gaseous pyrolysis products following the process in said pyrolysis chamber.

8. The incineration method according to claim 6, wherein solid and gaseous pyrolysis products are incinerated in separate part chambers of a solids or a gas incineration chamber, said part chambers being connected in series; the incineration of solid and gaseous pyrolysis products following the process in said pyrolysis chamber.

9. The incineration method according to claim 5, in an installation also having an ash disposal chamber below the combustion chamber and second gate elements arranged in the transitional area between the combustion chamber and the ash disposal chamber and which have a closed upper side and openings on the under side, comprising; moving said second gate elements to thereby open passages of different widths through which ash is discharged into the ash disposal chamber, and whereby the pyrolysis products which rest on the second gate elements are turned over when moving these elements, thus ensuring a complete incineration.

10. The incineration method according to claim 9, comprising: supplying secondary combustion air below the second swivelling gate elements for cooling the ash discharge from the solids incineration chamber into the ash disposal chamber and for the complete incineration of the pyrolysis products resting on the gate elements when recirculating to the solids incineration chamber.

* * * * *